US009969599B2

(12) United States Patent
Lossec

(10) Patent No.: US 9,969,599 B2
(45) Date of Patent: May 15, 2018

(54) RECEIVING ASSEMBLY FOR RECEIVING A SEAGOING VESSEL AND SYSTEM FOR RECOVERING AND DEPLOYING SUCH A VESSEL IN THE SEA

(71) Applicant: THALES, Neuilly sur Seine (FR)

(72) Inventor: Jean Jacques Lossec, Brest (FR)

(73) Assignee: THALES, Courbevoie (FR)

( * ) Notice: Subject to any disclaimer, the term of this patent is extended or adjusted under 35 U.S.C. 154(b) by 259 days.

(21) Appl. No.: 14/376,529

(22) PCT Filed: Jan. 28, 2013

(86) PCT No.: PCT/EP2013/051535

§ 371 (c)(1),
(2) Date: Aug. 4, 2014

(87) PCT Pub. No.: WO2013/113644

PCT Pub. Date: Aug. 8, 2013

(65) Prior Publication Data

US 2014/0377004 A1 Dec. 25, 2014

(30) Foreign Application Priority Data

Feb. 3, 2012 (FR) ..... 12 00320

(51) Int. Cl.
*B63C 3/06* (2006.01)
*B63C 3/12* (2006.01)
(Continued)

(52) U.S. Cl.
CPC ..... *B66C 13/02* (2013.01); *B63B 23/40* (2013.01); *B63B 23/60* (2013.01); *B63B 27/10* (2013.01);
(Continued)

(58) Field of Classification Search
CPC .... B63C 3/06; B63C 3/12; B63C 3/02; B63C 13/00; B63C 15/00; B63C 1/02;
(Continued)

(56) References Cited

U.S. PATENT DOCUMENTS 3,390,657 A * 7/1968 Schneider ..... B63B 27/12 114/260
3,436,113 A * 4/1969 Zweifel ..... B66C 1/101 212/326
(Continued)

FOREIGN PATENT DOCUMENTS

GB 2150903 A 7/1985
JP H07277671 10/1995
(Continued)

*Primary Examiner* — Benjamin F Fiorello
*Assistant Examiner* — Edwin J Toledo-Duran
(74) *Attorney, Agent, or Firm* — Baker & Hostetler LLP

(57) ABSTRACT

A receiving assembly for receiving a seagoing vessel is provided, to be suspended from an articulated arm of a handling structure which is provided with a lifting cable that is intended to carry a seagoing vessel and to move the vessel in a vertical direction to deploy and/or recover the vessel from the sea from a floating building on which the handling structure is secured, the receiving assembly comprising a lower part which comprises receiving means of the vessel, the receiving means having a passage for the cable and defining a cavity capable of receiving the vessel when the vessel is suspended from the lifting cable and arranged to ensure blocking of rotational and translational movements in the vertical direction upward of a seagoing vessel which is generally tubular in form, in relation to the receiving means, when the seagoing vessel is received by the cavity and comes to bear.

14 Claims, 5 Drawing Sheets

(51) Int. Cl.

| | |
|---|---|
| ***B66C 13/02*** | (2006.01) |
| ***B63B 23/40*** | (2006.01) |
| ***B63B 23/60*** | (2006.01) |
| ***B63B 27/10*** | (2006.01) |
| ***B66C 13/04*** | (2006.01) |
| ***B66C 23/52*** | (2006.01) |
| ***B66C 23/90*** | (2006.01) |

(52) U.S. Cl.
CPC ..... *B63C 3/06* (2013.01); *B66C 13/04* (2013.01); *B66C 23/52* (2013.01); *B66C 23/90* (2013.01)

(58) Field of Classification Search
CPC .... B63C 3/04; B63C 1/10; B63C 3/00; B63C 3/08; B63C 1/06; B63C 1/12; B63C 1/00; B63C 3/10; B63C 5/04; E02B 3/068; E02B 3/20; E02B 17/08
USPC ..... 405/1–7; 212/72–123, 328–346
See application file for complete search history.

(56) References Cited

U.S. PATENT DOCUMENTS

| | | | | | |
|---|---|---|---|---|---|
| 3,912,319 | A * | 10/1975 | Hamilton | B63B 27/36 | 212/307 |
| 4,216,987 | A * | 8/1980 | Ely | B66C 1/34 | 294/82.35 |
| 4,630,542 | A * | 12/1986 | Peyre | B66C 13/02 | 104/112 |
| 4,953,488 | A * | 9/1990 | Heidtmann | B63C 15/00 | 114/44 |
| 5,281,077 | A * | 1/1994 | Phillips | B66F 7/02 | 187/242 |
| 5,709,501 | A * | 1/1998 | Elbers | B63C 3/06 | 114/361 |
| 5,735,561 | A * | 4/1998 | Parkins | B63C 3/06 | 114/44 |
| 6,431,791 | B2 * | 8/2002 | Galluccio | B63C 3/06 | 212/312 |
| 6,494,155 | B2 * | 12/2002 | Gibson | B63C 3/06 | 114/44 |
| 7,908,988 | B1 * | 3/2011 | Khachaturian | B63B 27/16 | 114/51 |
| 2001/0020435 | A1 | 9/2001 | Ghignone | | |
| 2005/0089375 | A1 * | 4/2005 | Fox | B63B 17/02 | 405/219 |
| 2008/0181724 | A1 * | 7/2008 | Fogg | B63C 3/02 | 405/3 |
| 2009/0304480 | A1 * | 12/2009 | Rosenberg | B63C 15/00 | 414/281 |
| 2011/0100638 | A1 * | 5/2011 | Ramfjord | B23D 21/04 | 166/361 |
| 2012/0266803 | A1 * | 10/2012 | Zediker | B63G 8/001 | 114/337 |
| 2013/0200640 | A1 * | 8/2013 | Hellgren | B66C 1/663 | 294/81.1 |
| 2015/0129529 | A1 * | 5/2015 | Screaton | B66C 13/063 | 212/277 |
| 2015/0336775 | A1 * | 11/2015 | Ruivenkamp | B63B 23/58 | 405/3 |

FOREIGN PATENT DOCUMENTS

| | | |
|---|---|---|
| JP | 2005112622 | 4/2005 |
| WO | 0174655 A1 | 10/2001 |
| WO | 2010147518 A1 | 12/2010 |

* cited by examiner

RECEIVING ASSEMBLY FOR RECEIVING A SEAGOING VESSEL AND SYSTEM FOR RECOVERING AND DEPLOYING SUCH A VESSEL IN THE SEA

CROSS-REFERENCE TO RELATED APPLICATIONS

This application is a National Stage of International patent application PCT/EP2013/051535, filed on Jan. 28, 2013, which claims priority to foreign French patent application No. FR 1200320, filed on Feb. 3, 2012, the disclosures of which are incorporated by reference in their entirety.

FIELD OF THE INVENTION

The invention is situated in the maritime sector and more precisely concerns the handling and lifting systems that are mounted on buildings which float on the water, such as, for example, ships or platforms enabling seagoing vessels, for example surface or underwater vessels, to be launched and recovered from said buildings. The vessels considered are both towed vessels and autonomous vessels.

BACKGROUND

The handling and lifting systems generally comprise a handling structure (crane or gantry crane) which is integral with the floating building. Said structure comprises an articulated arm and is provided with a pulley which is capable of guiding a lifting cable at the free end of the articulated arm in the vertical direction and with a winch which is capable of winding/unwinding said cable.

The cable is provided with first hooking means which are capable of cooperating with second hooking means in order to suspend the vessel from the lifting cable.

The articulated arm allows the lifting cable to be positioned above the area for recovery or for launching in order to wind up or launch the vessel and above the storage area situated on the floating building in order to recover or store the vessel.

Conventionally, the first hooking means consist of a hook which is capable of cooperating with a ring that is secured on the vessel.

When the seagoing vessel is suspended from the lifting cable, it oscillates around an equilibrium position in which it is horizontal and pivots around the lifting cable.

This is all the more problematic as the floating building is subject to the swell. The seagoing vessel is therefore easily unbalanced and is likely to strike strongly against the structure of the floating building or the lifting and handling means or even the stevedores.

Furthermore, the transit movements carried out by the articulated arm via the lifting cable between the position for recovering or for launching and the storage position on the boat, even if they are slow and controlled, generate, aside from said critical excitation, supplementary spurts which further excite the movements of the vessel at the end of the crane cable. Said movements can make the recovering and launching operations difficult.

Thus, in relation to the state of the sea during the maneuver, the operation can turn out to be perilous for the equipment (risks of shocks between the vessel and the sea, the floating building or the handling structure) or for the people in charge of the operation (risk of shocks between the vessel and an operator).

SUMMARY OF THE INVENTION

One aim of the invention is to secure said operations for deploying and recovering in and from the sea.

The articulated arm is moved between a deploying and launching position in which the end of the arm is situated above the water and a delivery position in which the end of the arm is situated above the position for storing the vessel on the floating building. Between said two positions, the end of the arm undergoes translational movements (if, for example, the arm is telescopic) and pivots about one or several axes.

Said movements of the end of the arm generate relative vertical movements which excite the movements of the vessel at the end of the crane cable even more. In one direction they make the load descend, in the other they make it ascend in an uncontrolled manner, making the operations for recovering and launching even more difficult.

In order to limit said spurts and to stabilize the vessel, in the solutions of the prior art the operators wind or unwind the lifting cable simultaneously with the movements of the articulated arm bringing about a descent or an ascent of the end of the lifting cable so that the vessel stays at the same height. As the movements of the crane are slow, with a little experience an operator is capable of limiting the variations in height of the vessel to a maximum of 100 mm.

However, said solution has the disadvantage of requiring the operator to be available all the time.

There is another solution which consists in providing the traction winch with a constant traction device which also allows the vertical movements during the displacement of the articulated arm to be avoided.

However, said so-called active solution is costly and requires an electric power input.

Another aim of the invention is to overcome the above disadvantages.

To this end, the object of the invention is a receiving assembly for receiving a seagoing vessel which is able to be suspended from an articulated arm of a handling structure which is provided with a lifting cable that is intended to carry a seagoing vessel and to move said vessel in a vertical direction so as to deploy and/or recover said vessel in or from the sea from a floating building on which said handling structure is secured, said receiving assembly comprising a lower part which comprises receiving means of said vessel, said receiving means having a passage through which the cable is capable of passing, said receiving means defining a cavity which is capable of receiving said vessel when said vessel is suspended from the lifting cable and being arranged so as to ensure the blocking of rotational and translational movements in the vertical direction upward of a seagoing vessel which is generally tubular in form, in relation to the receiving means, when the seagoing vessel is received by the cavity and comes to bear against said means.

In an advantageous manner, the receiving assembly comprises one or several of the characteristics below taken on their own or in combination:

- whereby the receiving means have a U-shaped profile,
- whereby the U is flared,
- the U has two wings which are connected by a core, the wings being advantageously flared from their respective free ends up to the core,
- the receiving means are realized at least in part in compressible material that is elastically deformable so as to cushion the shocks between the vessel and the receiving means,
- the receiving assembly further comprises:

means for translational guidance allowing a degree of translational freedom in the vertical direction between the receiving means and a base when the latter is suspended from said arm, and a spring which is arranged so as to allow the receiving means to move from the base in the vertical direction when said receiving assembly is suspended from said arm.

the means for guidance are passive means which are coupled to the spring such that when the spring is compressed or extended, the means for guidance guide the movement of the receiving means in the direction in relation to the base, said receiving assembly comprises at least one visual indicator which is coupled to the spring in order to give a visual indication of the state of compression of the spring, said receiving assembly comprises a plurality of visual indicators which are arranged so as to form different geometric figures when the spring is at half-excursion, compressed to the maximum and in its equilibrium position, said receiving assembly is provided with a pulley which is intended to guide the lifting cable in the vertical direction when said receiving assembly is suspended from said arm, said receiving assembly is arranged so as to be able to be suspended from an articulated arm of a handling structure leaving at least one degree of rotational freedom about an axis perpendicular to the vertical direction between a lower part of the receiving assembly which comprises the receiving means and the handling structure, said receiving assembly comprises means which are intended to cushion the relative movements between the suspension arm and the lower part of the receiving assembly with at least one degree of rotational freedom, the means which are intended to cushion the relative movements between the suspension arm and the lower part of the receiving assembly with at least one degree of rotational freedom are passive, said receiving assembly comprises at least one mechanical fuse which is provided to shear off and disconnect the bottom part from the articulated arm when the range of the relative oscillating movement of the bottom part in relation to said arm with at least one degree of rotational freedom is superior to a predetermined threshold.

The object of the invention is also a device for deploying and recovering a seagoing vessel from a floating building which comprises a handling structure which comprises an articulated arm from which a receiving assembly according to the invention is suspended.

Furthermore, the object of the invention is also a method of utilizing a device for deploying and recovering a seagoing vessel according to the invention, in which, prior to moving the articulated arm in order to move the receiving assembly when the vessel is attached to the lifting cable, the lifting cable is wound such that the vessel comes to press against the receiving means and compress the spring up to approximately half-excursion.

BRIEF DESCRIPTION OF THE DRAWINGS

Other characteristics and advantages of the invention will appear when reading the detailed description which follows, given by way of a non-limited example and with reference to the accompanying drawings, in which.

The same elements are referenced by the same references from one figure to another.

DETAILED DESCRIPTION

Figure 1:
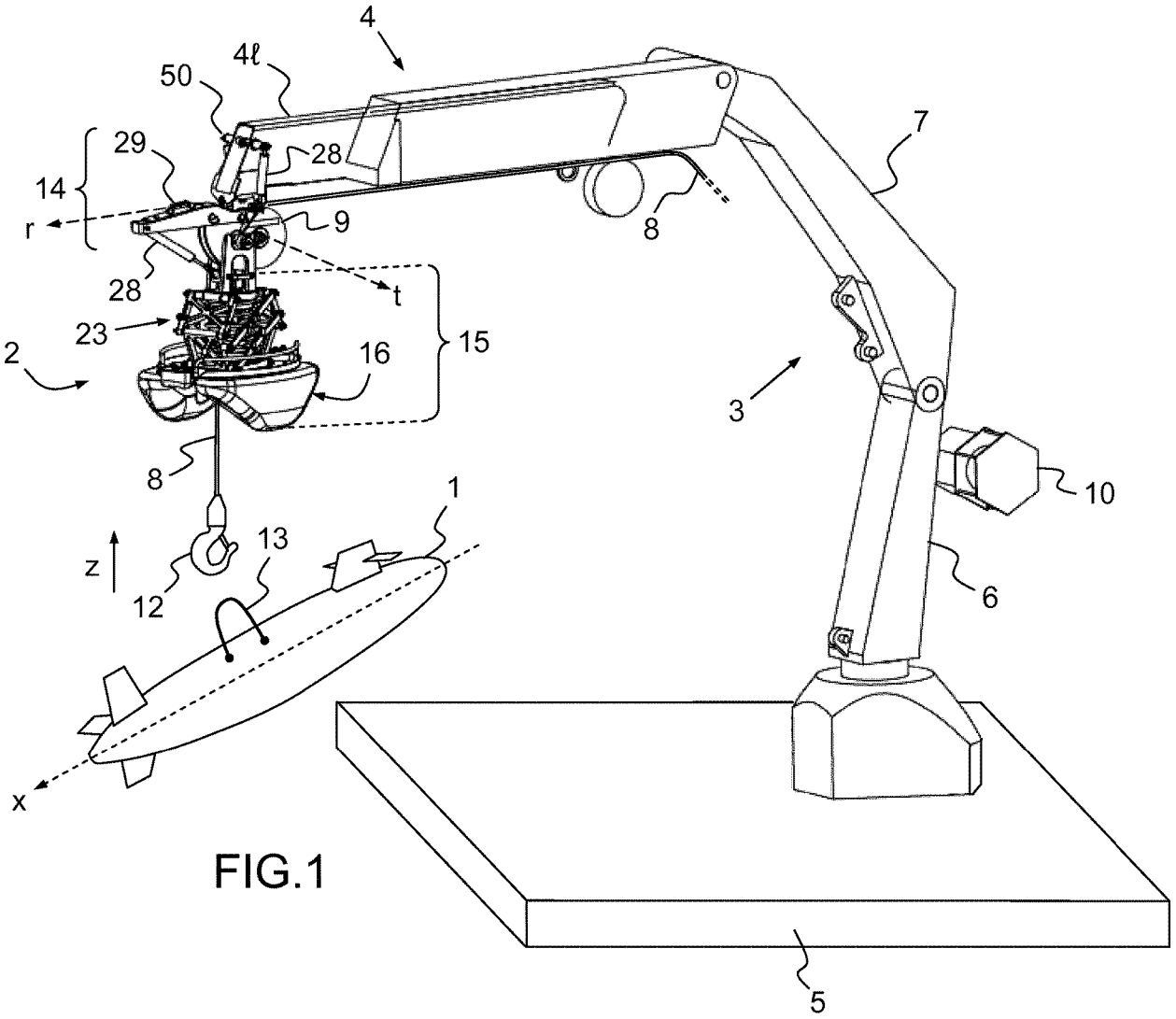
FIG. 1 shows a schematic representation in perspective of a device for recovering and deploying a vessel in the sea according to the invention, comprising a receiving assembly according to the invention.

FIG. 1 shows a device for deploying and recovering a seagoing vessel 1, according to the invention, comprising a receiving assembly 2, according to the invention, suspended from a handling structure 3.

The handling structure 3 is integral with a floating building 5 which is, for example, a boat or a platform floating on the water.

The handling structure 3 comprises an arm 4, called an articulated arm in the rest of the text, from which is suspended the receiving assembly 2. The articulated arm 4 is telescopic but could not be.

As a variant, the articulated arm 4 could be secured directly on the floating building and, for example, be in an arched form.

In the development in FIG. 1, the handling structure 3 is a crane which comprises a first arm 6 which is integral with the floating building, a second arm 7 which is articulated, on the one hand, to the first arm 6 and, on the other hand, to the articulated arm 4 from which the receiving assembly 2 is suspended.

The articulated arm 4 comprises a first end which is articulated to the second arm 7. The articulated arm 4 also comprises a free end 41 from which the receiving assembly 2 is suspended in an advantageous manner.

The handling structure 3 could also be a gantry crane which comprises a first arm which is integral with the floating building and an arm articulated to said first arm and from which the receiving assembly 2 is suspended.

The handling structure 3 is provided with a lifting cable 8 which is intended to draw the seagoing vessel 1 in the vertical direction z which is defined by the weight of the seagoing vessel. The cable 8 is only shown in part for more clarity.

The handling structure 3 is also provided with a winch 10 which allows the cable 8 to be wound and unwound and with means, not shown, which allow an operator to control the winch 10 for winding and unwinding the lifting cable 8.

Figure 4:
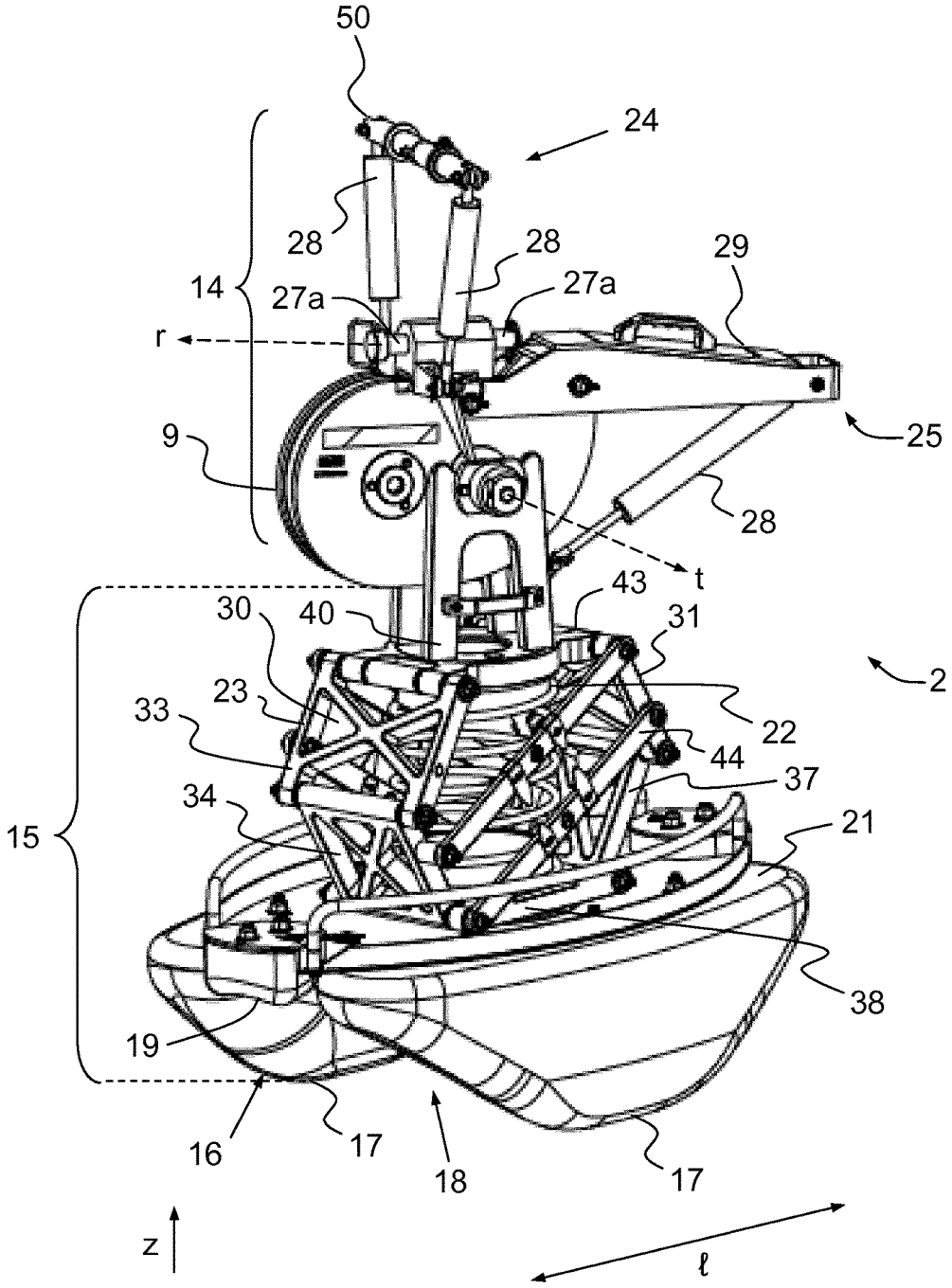
FIG. 4 shows a schematic representation in perspective of a receiving assembly according to the invention.

The lifting cable 8 is guided in the vertical direction z by means of a guide pulley 9. As can be seen in FIG. 4, the pulley 9 is included in the receiving assembly 2. Said solution allows the interfaces between the receiving assembly 2 and the crane 3 to be simplified. It is easier to incorporate the pulley in the receiving assembly than to provide interfaces between the receiving assembly and a pulley which is already secured to the crane.

As a variant, the pulley is integral with the articulated arm 4.

The lifting cable 8 is provided with first hooking means, which are realized in this case in the form of a hook 12, capable of cooperating with second hooking means 13 which are secured on the vessel 1 so as to be able to suspend said vessel from the lifting cable 8, that is to say so as to be able to carry it, tow it or move it in the vertical direction z.

The receiving assembly 2 comprises an upper part 14 which comprises the pulley 9 and a lower part 15 which comprises receiving means 16 which are opposite the seagoing vessel 1.

As can be seen in FIG. 1, the upper part 14 is situated, in the vertical direction z, at a height which is higher than the height of the receiving means when the receiving assembly 2 is suspended from the articulated arm 4.

The receiving means 16 are described in more detail with reference to FIG. 2.

The receiving means 16 have a passage 20 in which the cable 8 is capable of passing. The receiving means 16 define a cavity 18 which is capable of receiving the seagoing vessel 1 when said vessel is suspended from the lifting cable 8 such that the seagoing vessel 1 comes to abut against the receiving means 16.

The receiving means 16 are arranged so as to ensure the blocking of at least rotational and translational movements in the vertical direction z upward of a seagoing vessel 1, in relation to the receiving means 16, when the seagoing vessel 1 is received by the cavity 18 and comes to abut against said receiving means.

Said characteristic, when the vessel is suspended from the lifting cable 8, enables the oscillating movements of the vessel around the lifting cable 8 to be avoided. It therefore allows the deploying and launching maneuvers of the seagoing vessel to be secured Conventionally, the form of the vessels is tubular with an oval or round profile. In the development, the receiving means 16 are arranged so as to block the above-mentioned movements of a seagoing vessel which is generally tubular in form.

The receiving means 16 are, for example, dimensioned in order to ensure that a seagoing vessel 1, the hull of which has a diameter of curvature of between 300 and 330 mm inclusive, is blocked.

The receiving means 16 have a U-shaped profile which defines a cavity 18. In other words, the receiving means are generally in the shape of a horse saddle.

This allows, given the classic profile of seagoing vessels, an additional bearing surface to be formed from the curved part of the seagoing vessel 1 which surrounds the hooking means 13 and to block the vessel properly in a reliable manner.

The U is open downward when the receiving assembly 2 is suspended from the crane 3. In other words, its back faces the upper part 14.

The U has two lateral wings 17 which extend on both sides of a core 21 which forms the back of the U. The core 21 extends in a horizontal plane transversally between the two wings 17 and longitudinally over a denseness e shown in FIG. 3.

In an advantageous manner, the passage is arranged so as to be able to allow the hooking means 12, 13 to pass.

When the free end of the lifting cable 8 is mounted sufficiently high, the hooking means 12, 13 pass through the passage 20. The seagoing vessel 1, which is generally tubular in shape (generally with an oval or round profile), comes to rest within the cavity 18 and abuts against the core 21 and the wings 17 of the U. In other words, in said configuration, the receiving means 16 straddle the seagoing vessel 1. The core 21 acts as a vertical stop and the wings 17 act as lateral stops on both sides of the seagoing vessel 1 along an axis perpendicular to the vertical direction.

This therefore prevents the following movements of the vessel in relation to the receiving means 16: translational movements in the vertical direction upward and in a horizontal direction connecting the two wings and the rotational movements along an axis perpendicular to the vertical direction. A function of the receiving means 16 is to capture and stabilize the seagoing vessel 1.

The shape of a horse saddle allows the seagoing vessel 1 to be immobilized even if it is not horizontal (that is to say when the longitudinal axis x of the seagoing vessel is not perpendicular to the axis z) at the point when it abuts against the receiving means 16. It is the shape of the receiving means which forces it to take up said position. More particularly, this originates from the fact that the core 21 has a certain length l, and more particularly that it forms a vertical stop which extends over a certain length.

In the development in the figures, the length of the core is approximately 90 cm. The length of the free ends of the wings, on the other hand, is approximately 10 cm. Hence, when the vessel is low, the wings allow the vessel a large amount of freedom (notably one degree of rotational freedom about the axis z) and when the vessel comes to abut against the core, the vessel is very constrained and rotation of the vessel in relation to the receiving means about the axis z is blocked.

In the development in the figures, the U is flared. This enables the longitudinal axis of the vessel to yaw at an angle of up to 45° in relation to the longitudinal direction (or the direction of the length l) of the core of the U.

To sum up, the shape of the receiving means facilitates the blocking of the vessel within the receiving means 16. It is not necessary for the axis of the vessel to be aligned with the core of the U for the vessel to be able to be recovered by the receiving means.

In order to use said advantage, the wings 17 are advantageously flared from their respective free ends up to the core 21. In the development in the figures, they are in the general form of a downwardly pointing triangle.

In an advantageous manner, the receiving means 16 comprise means which enable shocks with the vessel 1 to be absorbed, when said vessel enters the cavity.

For example, the wings 17 and/or the core 21 are realized at least in part in compressible material that is elastically deformable for this purpose. Said characteristic also allows vessels with different radii of curvature or irregular shapes or shapes that are more complex than a straight cylinder to be blocked.

In the development in the figures, the wings 17 are realized in compressible foam covered with a polyurethane skin which is resistant to the marine environment and to abrasion. The compressibility of the foam is chosen in terms of the usage (density varying in order to absorb shocks and profiles of the vessels). In an advantageous manner, the density of the foam is between 50 to 80 kg/m$^3$ inclusive.

The core 21 comprises two vertical stops 19 (can be better seen in FIGS. 3*a* to 3*c*) which are arranged on both sides of the wings 17 and against which the vessel 1 is intended to be supported when an operator winds in the cable 8.

In an advantageous manner said vertical stops 19 are realized at least in part in compressible material that is elastically deformable, for example, using the same materials as the wings.

The shape and the dimensions of the receiving means can be easily adapted in order to block the movements of seagoing vessels having different diameters and shapes. It is only necessary to realize receiving means which define and form a bearing surface that is complementary to the shape of the seagoing vessel to be recovered around the second hooking means 13.

The lower part 15 comprises a spring 22 which is arranged so as to allow the receiving means 16 to move from a base 40, which is secured as regards translational movement in relation to the articulated arm 4, in the vertical direction z when the receiving assembly 2 is suspended from the handling structure 3 (and in its equilibrium position). The term spring 22 refers to a functional means which allows a calibrated force to be exerted in a predetermined direction. The predetermined direction in this case is perpendicular to the core 21 of the U.

In an advantageous manner said functional means comprises at least one compression spring, strictly speaking as in the embodiment shown in the figures of the patent application.

In other words, the spring 22 is arranged so as to be able to move the lower part 15 from the base 40 in a predetermined direction which is intended to be the vertical direction when the receiving assembly 2 is suspended from the crane 3 and is in an equilibrium position.

Figure 2:
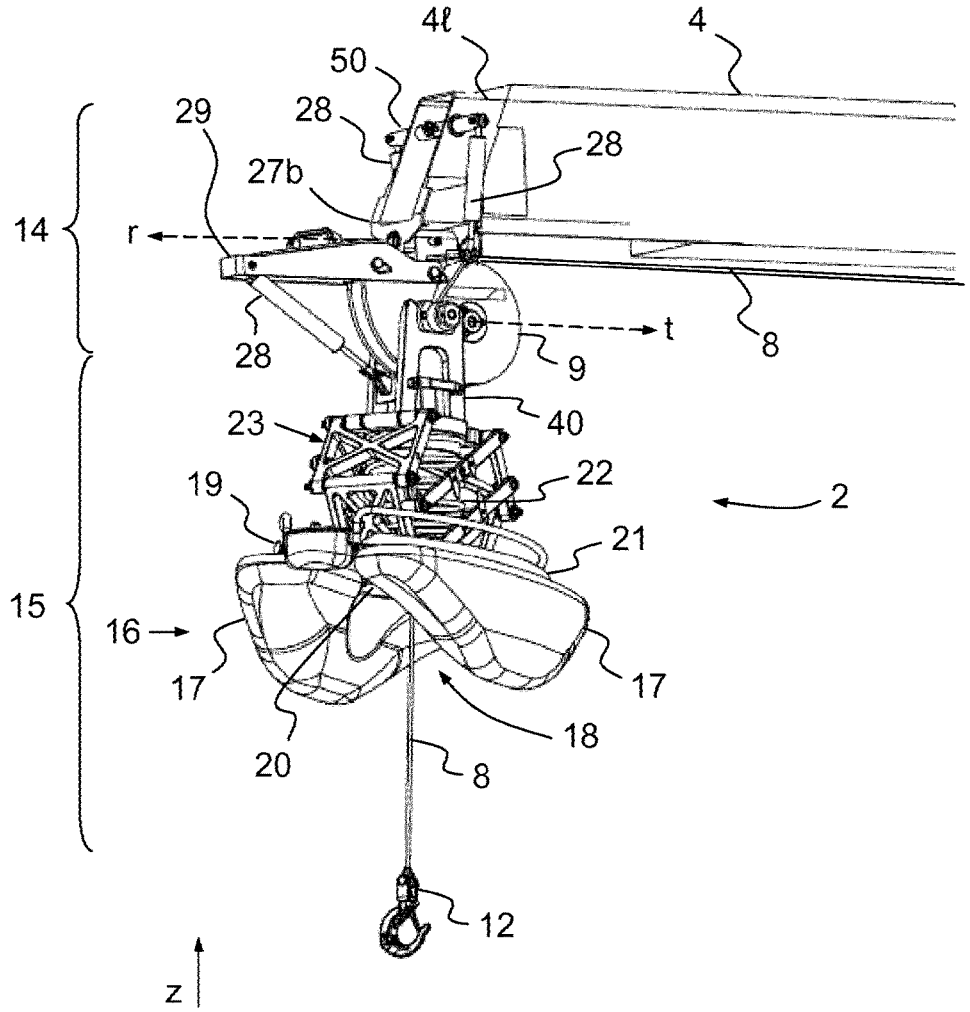
FIG. 2 shows a schematic representation in perspective of part of the device for deploying according to the invention.

As can be seen in FIG. 2, when the receiving assembly 2 is suspended from the articulated arm 4, the spring 22 is suspended from the base 40 and the receiving means 16 are suspended from the spring 22.

In said configuration, the receiving means 16 exert a force on the spring 22 which tends to extend it in the vertical direction z which is also the direction defined by the weight of the receiving means 16. The axis of the spring extends in the vertical direction z. In said configuration, the receiving assembly 2 and the spring 22 are in their respective equilibrium positions. The core 21 of the U extends perpendicularly to the vertical direction z.

The receiving assembly 2 also comprises means for translational guidance 23, allowing one degree of translational freedom in a direction of guidance which is perpendicular to the core of the U between the base 40 and the receiving means 16. Said direction of guidance is the vertical direction z, when the receiving assembly 2 is suspended from the crane 3 and in its equilibrium position.

The operation of the receiving assembly 2 will now be explained more precisely. The operation for recovering a vessel from the sea is explained below. The operation for deploying comprises the same steps but they are executed in the reverse order.

The receiving assembly 2 is initially suspended from the crane 3 so that the pulley 9 guides the lifting cable 8 in the vertical direction z and so that it is able to move along the passage 20. In the development in the figures, the spring 22 is arranged above the passage 20. The cable 8 also moves in the spring 22.

An operator activates the crane 3 so that the receiving assembly 2 comes to be positioned above the vessel 1 in the sea. This is realized, for example, by making the articulated arm 4 pivot about a vertical axis. An operator unwinds the lifting cable 8, using the winch 10, so as to position the hook 12 which is positioned with its free end in the vicinity of the second hooking means 13. As can be seen in FIG. 1, in said position the free end of the cable 8 is positioned below the receiving means 16, that is to say at a height which is lower than the height of said receiving means.

The hook 12 which is arranged at the end of the lifting cable 8 is lowered in the vicinity of the second hooking means 13 which are realized in this case in the form of a lifting ring. An operator provided with a long pole connected to the hook 12 mechanically connects the hook 12, and therefore the cable 8, to the lifting ring 13 which is integral with the seagoing vessel 1 so as to be able to lift it.

An operator winds in the cable 8 using the lifting winch 10 in order to land the vessel 1 out of the water in the vertical direction z. During said operation, the receiving means 16 are not moved. Instead, the vessel 1 ascends in the direction of the receiving means 16.

When the operator continues to wind in the cable 8, the upper part of the vessel 1 comes to rest in the cavity 8. The hook 12 and the ring 13 move along the passage 20 and the vessel 1 comes to be supported against the receiving means 16. More precisely, the vessel comes to be supported against the vertical stops 19 and against the wings 17. The receiving means 16 are then straddling the vessel 1.

When the operator continues to wind in the cable 8, the cable 8 exerts, on the vessel 1, a pulling force which is oriented in the vertical direction upward. The vessel 1 presses on the receiving means 16 which are displaced upward in the vertical direction z (defined by the means for guidance) and come to compress the compression spring 22. The spring 22 reacts and then exerts on the vessel 1, via the receiving means 16, a force in the vertical direction z which is oriented downward. The effect of said latter force, called an application force, is to press the vessel 1 against the receiving means 16.

The spring 22 ensures the vessel is continually pressed against the receiving means. This allows the vessel to be permanently immobilized by the receiving means.

The presence of the spring and of the means for guidance provides a real advantage compared to the solutions of the prior art. It allows the operations for deploying and launching at sea to be secured, notably during the stages of moving the free end of the articulated arm, whilst using the crane operator at a minimum, is relatively cheap and does not require power input.

Indeed, when the vessel 1 is pressed against the receiving means 2 and the end of the articulated arm 4 is displaced upward or downward, the spring 22 is compressed or respectively extended, whilst continually exerting a pressing force onto the vessel 1. The pressing force allows the vessel to be stabilized during said operations.

Said solution also allows the tension in the lifting cable 8 to be increased without risking going to the safety limits of the lifting winch of the crane, when the crane movements 3 cause the vessel to rise in the base.

In an advantageous manner, the operator utilizes the receiving assembly according to the invention in the following way: prior to moving the articulated arm 4 in order to move the receiving assembly 2 when the vessel 1 is hooked to the lifting cable 8, he winds in the lifting cable 8 so that the vessel 1 comes to press against the receiving means 16 and compress the spring 22 up to approximately half-excursion.

The excursion of the spring 22 is the distance covered by the end of the spring between its equilibrium position in which the receiving means 16 are suspended from its end and its compression position in which it is compressed to the maximum.

In this way, when the movements of the articulated arm 4 bring about a displacement of the free end of the cable 8 which is less than the half-excursion of the spring 22, the spring 22 ensures the vessel 1 is pressed against the receiving means 16, such that the free end of the lifting cable 8 moves upward or downward. Said system allows the pressing of the vessel to be ensured at all times even if the crane movements cause the vessel to be lowered.

In an advantageous manner, the excursion of the spring between its equilibrium position in which the receiving means are suspended from the spring and its compressed position in which it is compressed to the maximum is between 100 mm and 300 mm inclusive.

To proceed in this manner, the operator of the crane must pay attention and activate the lifting winch 10 in order to adjust the vertical position of the vessel 1 within the receiving means 16 and must check that the movements of the end of the crane 3 do not exceed the half-excursion of the spring upward or downward.

In an advantageous manner, the receiving assembly comprises at least one visual indicator which is coupled to the spring in order to give a crane operator a visual indication of the state of the compression of the spring.

Figure 3A:
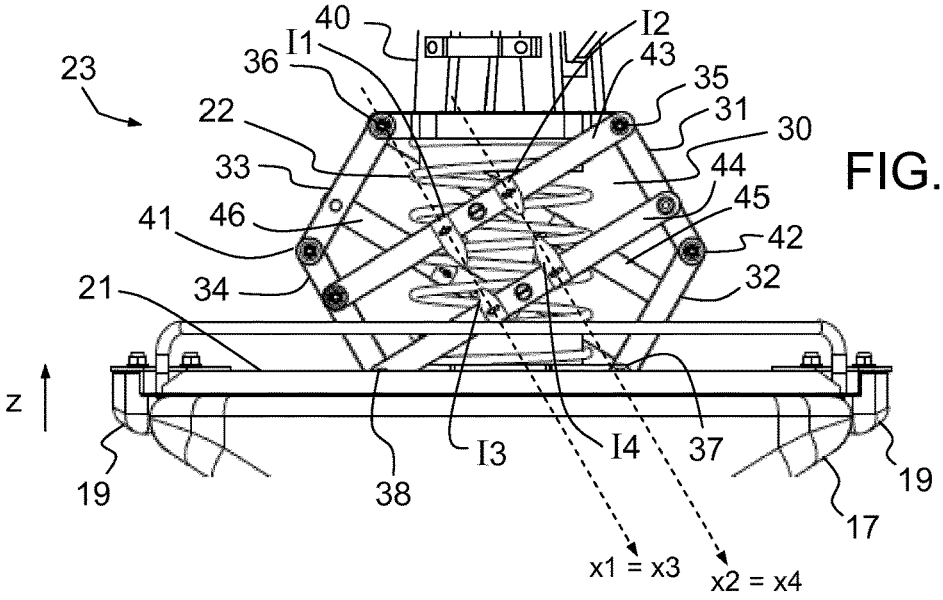
FIGS. 3*a*, 3*b*, 3*c* show schematic representations of the visual indicators of the receiving assembly according to the invention when the spring is in its equilibrium position, at half-excursion and respectively compressed to the maximum.
Figure 3B:
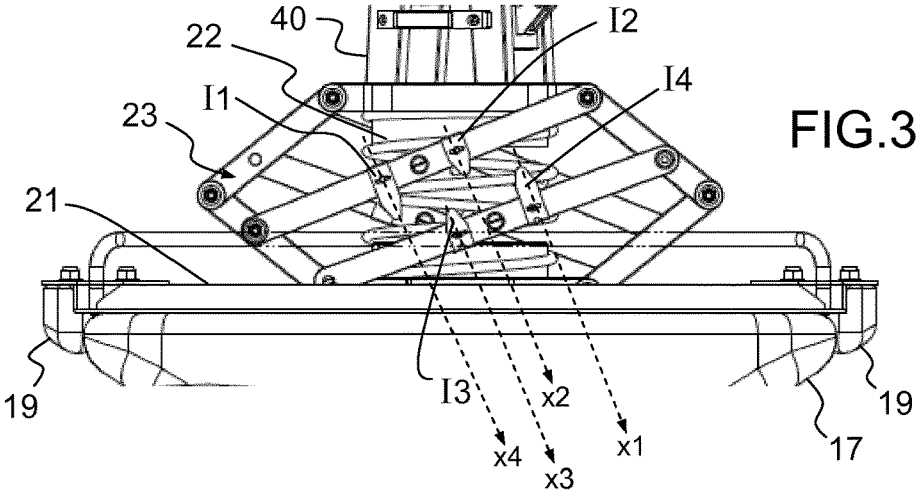
Figure 3C:
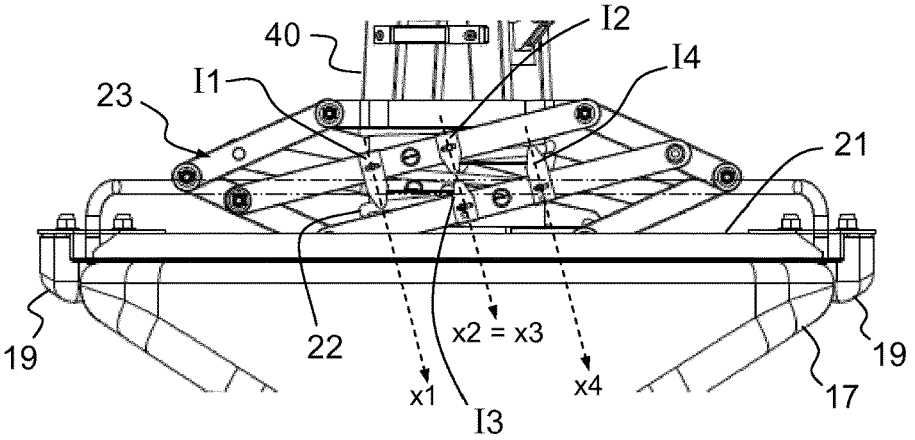

In the development shown in FIGS. 3*a* to 3*c*, the receiving assembly comprises several visual indicators.

Said visual indicators are provided on the means for guidance 23.

In order to better understand the provision of the visual indicators, the means for guidance 23 will first be described more precisely with reference to FIGS. 3*a* to 3*c*.

These are passive means for guidance. To this end, the means for guidance are coupled to the spring 22 such that when the spring 22 is compressed or extended, the means for guidance 23 guide the movement of the receiving means 16 in relation to the base 40 in the z direction.

In the non-limiting embodiment, shown here, the means for guidance 23 are realized in the form of an articulated assembly also called a pantograph system. Said device comprises articulations about axes which are parallel to one another and perpendicular to the guiding direction.

The means for guidance 23 are in the form of a hexagon in a plane which is parallel to the axis of the spring 22 and perpendicular to the core 21.

The hexagon is sufficiently dense in order to define a housing 30 in which the spring 23 is accommodated.

As can be seen in FIG. 3*a*, the articulated hexagon 23 comprises two pairs of consecutive sides 31, 32, and 33, 34, each comprising a first 35, 36 and a second 37, 38 non-consecutive apex articulated to the base 40 and, respectively, to the core 21 of the receiving means 16.

The hexagon comprises two free apices 41, 42 which define a diagonal of the hexagon having a variable length and extending in a plane which is perpendicular to the degree of translational freedom defined by the means for guidance 23.

All the articulations are realized along axes which are parallel to one another and perpendicular to the degree of translational freedom defined by the means for guidance 23.

The first 31, 32 and second 33, 34 pairs of consecutive sides are connected by two pairs of parallel rods 43, 44 and 45, 46.

More precisely, the first 31, 32 and second 33, 34 pairs of sides each comprise an upper side 31, 33 and a lower side 32, 34.

A first pair of parallel rods 43, 44 connect the upper side 31 of the first pair of consecutive sides to the lower side 34 of the second pair. A second pair of parallel rods 45, 46 connect the lower side 32 of the first pair of consecutive sides to the upper side 33 of the second pair of consecutive sides.

The visual indicators I1, I2, I3, I4 are arranged on the rods of a pair of rods 43, 44. They are arranged so as to form different geometric figures when the spring is at half-excursion, compressed to the maximum and in its equilibrium position.

They comprise a first pair of visual indicators I1, I2 and a second pair I3, I4 of visual indicators which are arranged on the respective rods 43, 44 of a pair of parallel rods so as to be moved in the direction of the rods in opposite directions during the compression or elongation of the spring.

The first I1, second I2, third I3 and fourth I4 visual indicators extend longitudinally along the first x1, second x2, third x3 and fourth x4 respective parallel axes.

As can be seen in FIG. 3*a*, they are arranged so as to extend longitudinally along just two parallel axes x1=x3, x2=x4 when the spring 22 is in its equilibrium position. They therefore define a rectangle.

As can be seen in FIG. 3*c*, they are also arranged so as to extend along just three parallel axes x1, x2=x3, x4 when the spring 22 is compressed at the maximum. In other words, two indicators I2, I3 extend longitudinally along a same axis x2=x3.

As can be seen in FIG. 3*b*, when the spring 22 is at half-excursion, the indicators I1, I2, I3, I4 extend longitudinally along 4 different respective axes x1, x2, x3, x4. This is the geometric figure that the operator tries to obtain prior to any movement of the crane.

In an advantageous manner, each visual indicator has a different color from the means for guidance 23 so as to be easily identifiable by an operator.

The receiving assembly 2 is arranged so as to be able to be suspended from an articulated arm 4 of a handling structure 3 allowing at least one degree of rotational freedom between the lower part 15 of the receiving assembly 2 and the handling structure 3.

The expert knows how to arrange the receiving assembly easily in order to be able to realize said type of suspension. Referring to the figures, we will describe, in a more precise manner, an exemplary embodiment of the receiving assembly which enables said type of suspension to be realized.

The fact of allowing at least one degree of rotational freedom enables the forces applied by the bottom part 15 of the receiving assembly 2 on the crane 3 when the sea is rough to be limited.

In an advantageous manner, the bottom part 15 is secured non-rotatably about the vertical axis z in relation to the articulated arm 4. Said characteristic allows the bottom part 15 to be oriented definitively in terms of the desired kinematics such that its own geometry ensures just as good an ad hoc orientation in its start position, characteristic of the recovering above the water, as in its final position, above the platform. The fact that the degree of rotational freedom about the z axis is suppressed greatly simplifies the design of the structure and increases its rigidity.

In an advantageous manner, the receiving assembly 2 comprises, as can be seen in FIG. 4, means 24, 25, to cushion the relative movements between the suspension arm 4 and the lower part 15 of the receiving assembly 2 with at least one of said degrees of rotational freedom. Said means do not have to form part of the receiving assembly 2.

The expert easily knows how to choose and arrange passive damping means which have said damping function. We will describe more precisely, with reference to the figures, an exemplary embodiment of said damping means.

In an advantageous manner, said damping means are passive.

The term passive means refers to means which do not require any power input.

In the development in the figures, as can be seen in FIG. 2, the receiving assembly 2 is suspended from the articulated arm 4 so as to unleash two degrees of rotational freedom between the receiving means 16, and in this case more precisely between the bottom part of the receiving means 14, and the articulated arm 4, about two axes r, t perpendicular to the axis of the spring 22. Said degrees of rotational freedom about an axis r, called the roll axis, parallel to the axis of the articulated arm 4 and about a pitch axis t set crosswise with respect to the arm 4. They allow the verticality of the lower part 15 and notably of the spring 22 to be kept when the articulated arm 4 is rocked by roll and pitch movements as a result of the roughness of the sea.

The bottom part 15 is rotatably secured to the pulley 9 about a first axis, called the first pitch axis t which is also perpendicular to the axis of the spring 22.

As can be seen in FIG. 4, the pulley 9 is provided with hanging means 27*a* which are intended to cooperate with complementary means 27*b*, visible in FIG. 2, which are integral with the articulated arm 4 (which in this case are openings) so as to secure said pulley 9 so as to rotate about the roll axis r.

The receiving assembly 2 is arranged so that the axis of the spring extends in the vertical direction z when the receiving assembly is in its equilibrium position about which it is capable of oscillating (about the roll and pitch axes) when it is suspended from the articulated arm 4.

In the development in the figures, the receiving assembly 2, and more precisely the upper part 14, includes means 24, 25 to cushion said two rotational movements. Said means 24, 25 comprise first cushioning means 24 to cushion the relative movements of the bottom part 15 of the receiving assembly 2 in relation to the arm about the roll axis r and second cushioning means 25 to cushion the relative movements of the bottom part 15 of the receiving assembly 2 in relation to the arm about the pitch axis t.

The dynamic energy induced by the relative movements of the receiving assembly in relation to the articulated arm, about the roll axis r and the pitch axis t, and which are generated by the roughness of the sea, are able to be absorbed by said means.

Said means 24, 25 in this case comprise viscoelastic shock absorbers 28 but another type of passive shock absorber could also be used just as well. The viscoelastic shock absorbers comprise, for example, a silicone oil, the viscous properties of which allow the energy induced by the dynamic movements to be absorbed.

More precisely, the first damping means 24 comprise two viscoelastic shock absorbers 28 which are intended to be arranged so as to cushion the rotational movements about the roll axis r.

Figure 5:
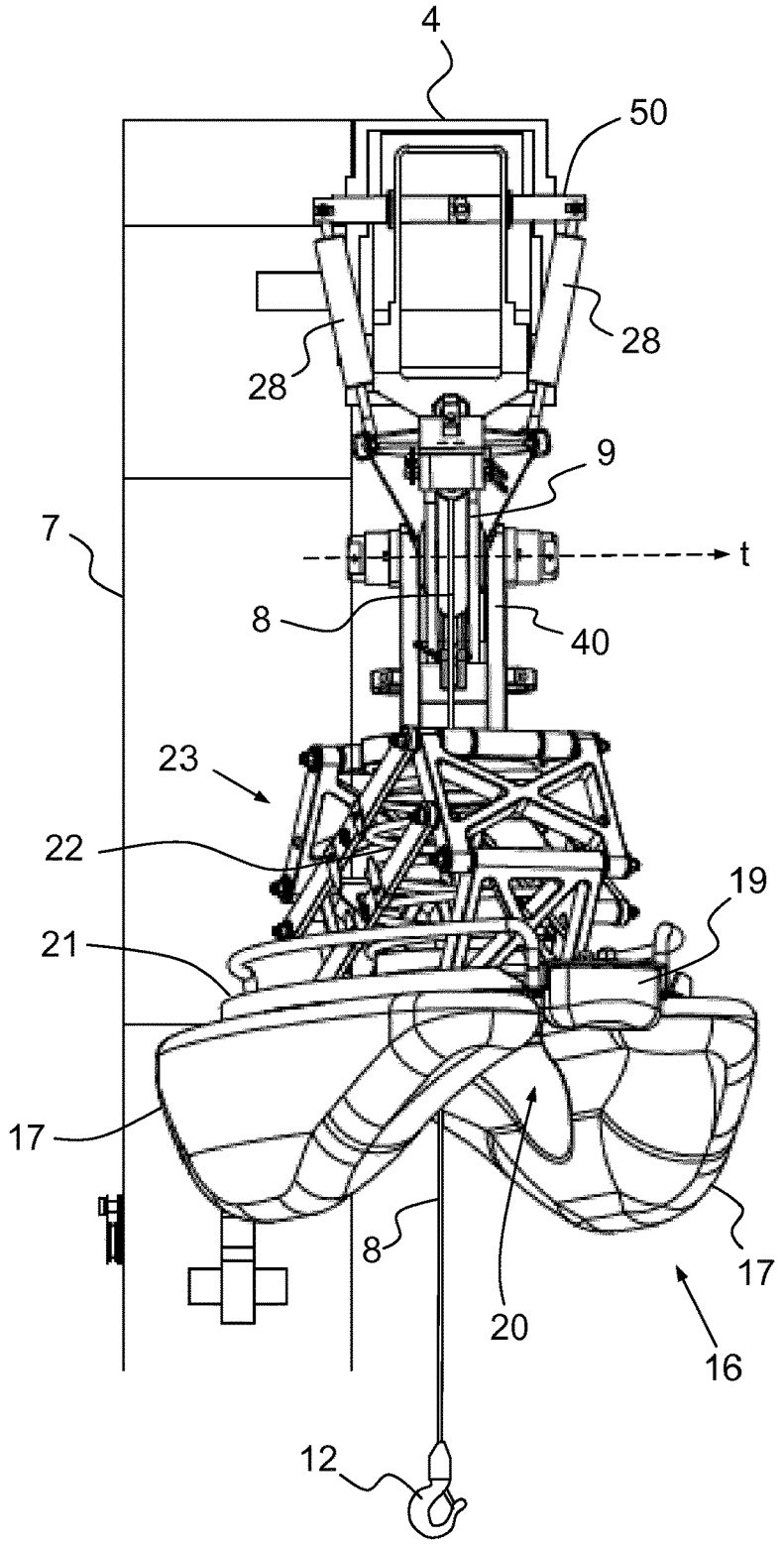
FIG. 5 shows a schematic representation of part of the device according to the invention in a front view perpendicularly to the articulated arm.

As can be seen in FIGS. 4 and 5, said viscoelastic shock absorbers 28 are connected on the one hand to the pulley 9 and on the other hand to the articulated arm 4 by hooking means 50 which are secured to the arm 4 so as to rotate about an axis parallel to the pitch axis t.

The second damping means 25 comprise a shock absorber 28 which is arranged so as to cushion the rotational movements about the pitch axis t. It is connected on the one hand to the bottom part 15 (and more precisely to the base 40) and on the other hand to a damping arm 29 which is integral with the pulley 9.

The receiving assembly 2 comprises in an advantageous manner mechanical fuses, not shown, provided to shear off and disconnect the bottom part 15 from the crane 3 when the range of the relative oscillating movement of the bottom part 15 in relation to the crane is too great.

Said fuses comprise at least one fuse provided to shear off when the lower part 14 of the receiving assembly forms, about the roll axis, an angle that is greater than a first predetermined threshold angle with its equilibrium position in which the axis of the spring is vertical and/or at least one fuse provided to shear off when the lower part 14 of the receiving assembly forms, about the roll axis, an angle which is greater that a second predetermined threshold angle with its equilibrium position in which the spring axis is vertical.

The first angle, for example, is equal to 20° and the second angle, for example, is equal to 35°.

Said fuses, for example, are mounted on the interface between each shock absorber and the crane. They shear off when the associated shock absorber has reached its maximum excursion. When they shear off, they disconnect in part the saddle from the crane in order to protect it from peaks of force that it would not be capable of tolerating.

As seen previously, in the development in the figures, the bottom part of the receiving assembly is not freely rotatable, compared to the lifting arm 4, about a vertical axis.

However, in the event of an offset shock at one end of the vessel, due either to a large wave or a radial shock against an element of the floating building, for example, the force caused creates a torque which can damage both the seagoing vessel and the crane.

In an advantageous manner, the receiving assembly comprises means which are capable of permitting rotation of the bottom part 15 of the receiving assembly 2 about a vertical axis when the receiving means 16 transmit to the crane 3 a torque that is in excess of a predetermined threshold.

This is, for example, a question of shear pins which are capable of shearing off when the torque which is transmitted to them by the receiving means 16 is in excess of a third predetermined threshold so as to give the receiving means 16 their rotational freedom about a vertical axis. This allows both the vessel 1 and the crane 3 to be protected by preventing the transmission of large forces to the crane.

The receiving assembly 2 according to the invention is a simple mechanical system that can easily be suspended from any type of standard crane. It is capable of capturing a vessel, of pressing it against the receiving means and of cushioning the movements between the receiving means and the crane without requiring a supply of power. Its passive design makes it simple to implement, to operate and to maintain.

The invention claimed is:

1. A receiving assembly for receiving a seagoing vessel, wherein said seagoing vessel is able to be suspended from an articulated arm of a handling structure which is provided with a lifting cable that is intended to carry the seagoing vessel and to move said vessel in a vertical direction so as to at least one of deploy and recover said vessel in or from the sea from a floating building on which said handling structure is secured, said receiving assembly comprising a lower part which comprises receiving means of said vessel, said receiving means having a passage through which the lifting cable is capable of passing, said receiving means defining a cavity which is capable of receiving said vessel when said vessel is suspended from the lifting cable and being arranged so as to ensure the blocking of rotational and translational movements in the vertical direction upward of the seagoing vessel, in relation to the receiving means, when the seagoing vessel is received by the cavity and comes to bear against said receiving means, said assembly being arranged so as to be able to be suspended from the articulated arm of the handling structure leaving at least one degree of rotational freedom about an axis perpendicular to the vertical direction between the lower part of the receiving assembly which comprises the receiving means and the handling structure, and the receiving assembly further comprising at least one mechanical fuse which is provided to shear off and disconnect a bottom part from the articulated arm when the range of the relative oscillating movement of the bottom part in relation to said arm with at least one degree of rotational freedom is superior to a predetermined threshold.

2. The receiving assembly as claimed in claim 1, in which the receiving means have a U-shaped profile.

3. The receiving assembly as claimed in claim 2, in which the U-shaped profile is flared.

4. The receiving assembly as claimed in claim 2, in which the U-shaped profile has two wings which are connected by a core, the wings being advantageously flared from their respective free ends up to the core.

5. The receiving assembly as claimed in claim 2, in which the receiving means are realized at least in part in compressible material that is elastically deformable so as to cushion shocks between the vessel and the receiving means.

6. The receiving assembly as claimed in claim 1, further comprising:

a translation guide allowing a degree of translational freedom in the vertical direction between the receiving means and a base when the latter is suspended from said arm, and a spring which is arranged so as to allow the receiving means to move from the base in the vertical direction when said receiving assembly is suspended from said arm.

7. The receiving assembly as claimed in claim 6, in which the translation guide is passive and is coupled to the spring such that when the spring is compressed or extended, the translation guide guides the movement of the receiving means in the direction in relation to the base.

8. The receiving assembly as claimed in claim 6, in which the receiving assembly comprises at least one visual indicator which is coupled to the spring in order to give a visual indication of the state of compression of the spring.

9. The receiving assembly as claimed in claim 8, comprising a plurality of visual indicators which are arranged so as to form different geometric figures when the spring is at half-excursion, compressed to the maximum and in its equilibrium position.

10. The receiving assembly as claimed in claim 1, said assembly being provided with a pulley which is intended to guide the lifting cable in the vertical direction when said receiving assembly is suspended from said arm.

11. The receiving assembly as claimed in claim 1, comprising cushion means for cushioning the relative movements between a suspension arm and the lower part of the receiving assembly with at least one degree of rotational freedom.

12. The receiving assembly as claimed in claim 11, in which the means which are intended to cushion the relative movements between the suspension arm and the lower part of the receiving assembly with at least one degree of rotational freedom are passive.

13. A device for deploying and recovering the seagoing vessel from the floating building which comprises the handling structure which comprises the articulated arm from which the receiving assembly as claimed in claim 1 is suspended.

14. A method of utilizing the device for deploying and recovering the seagoing vessel as claimed in claim 13, further comprising a translation guide allowing a degree of translational freedom in the vertical direction between the receiving means and a base when the latter is suspended from said articulated arm, and a spring which is arranged so as to allow the receiving means to move from the base in the vertical direction when said receiving assembly is suspended from said articulated arm, in which, prior to moving the articulated arm in order to move the receiving assembly when the vessel is attached to the lifting cable, the lifting cable is wound such that the vessel comes to press against the receiving means and compress the spring up to approximately half-excursion.

* * * * *